US007686428B2

(12) United States Patent
Komuro

(10) Patent No.: US 7,686,428 B2
(45) Date of Patent: Mar. 30, 2010

(54) LIQUID DISCHARGE HEAD

(75) Inventor: Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 325 days.

(21) Appl. No.: 11/735,102

(22) Filed: Apr. 13, 2007

(65) Prior Publication Data

US 2007/0247494 A1 Oct. 25, 2007

(30) Foreign Application Priority Data

Apr. 21, 2006 (JP) ..... 2006-117897

(51) Int. Cl.
*B41J 2/05* (2006.01)

(52) U.S. Cl. ..... 347/59

(58) Field of Classification Search ..... 347/50, 347/58, 59, 65

See application file for complete search history.

(56) References Cited

U.S. PATENT DOCUMENTS

| | | | | |
|---|---|---|---|---|
| 4,873,622 | A | 10/1989 | Komuro et al. | |
| 6,231,165 | B1 | 5/2001 | Komuro | |
| 6,491,834 | B1 * | 12/2002 | Kubota et al. | 216/27 |
| 6,634,736 | B2 | 10/2003 | Miyakoshi et al. | |
| 7,250,113 | B2 | 7/2007 | Komuro et al. | |

FOREIGN PATENT DOCUMENTS

| | | |
|---|---|---|
| JP | 61-16862 | 1/1986 |
| JP | 2002-067328 | 3/2002 |

* cited by examiner

*Primary Examiner*—An H Do
(74) *Attorney, Agent, or Firm*—Fitzpatrick, Cella, Harper & Scinto

(57) ABSTRACT

A liquid discharge head includes a substrate having a discharge port, a plurality of energy generating elements disposed on a first surface of the substrate for generating energy to discharge liquid from the discharge port, a liquid supply port, and a member provided on the first surface and forming a wall of a liquid chamber and a wall of a liquid path from the liquid supply port through the liquid chamber to the discharge port. A plurality of first penetrating electrodes penetrate the substrate from the first surface to the second surface, wherein one of the first penetrating electrodes electrically connects one of the energy generating elements, and a plurality of second penetrating electrodes penetrate the substrate from the first surface to the second surface, wherein one of the second penetrating electrodes electrically connects to the same energy generating element connected to the first penetrating electrode. Also, first and second power wirings are provided, and a plurality of driving elements are electrically connected between the first penetrating electrode and the first power wiring, correspondingly to each of the energy generating elements, to drive and control the energy generating elements.

3 Claims, 8 Drawing Sheets

LIQUID DISCHARGE HEAD

BACKGROUND OF THE INVENTION

1. Field of the Invention

The present invention relates to a liquid discharge head which discharges a liquid.

2. Description of the Related Art

Heretofore, a liquid discharge head has been configured to discharge a liquid in a direction vertical to the surface of the head on which a heating resistor is disposed, and the head has been put to practical use. In such a liquid discharge head, as shown in FIG. 7A, in general, a liquid supply port 302 is rectangular as viewed from an upper surface of a head substrate 301, and liquid discharge ports 303 are linearly arranged as rows of discharge ports on opposite sides of the liquid supply port. It is to be noted that the arranged rows of liquid discharge ports 303 open at a discharge port open surface 305. FIG. 7B is a sectional view cut along the 7B-7B line of FIG. 7A. As shown in the drawing, heating resistors (hereinafter referred to as the heaters) 304 are arranged so as to face the liquid discharge ports 303, and the heaters generate thermal energy as discharge energy to discharge the liquid.

However, if the heaters 304 are highly densely arranged, it is difficult to linearly arrange the liquid discharge ports 303 as described above. This is because there are dimensional restrictions due to heater sizes and bore diameters of the liquid discharge ports 303. Therefore, instead of linearly arranging the liquid discharge ports 303 as the rows at the discharge port open surface 305 (one-dimensional arrangement), a method (two-dimensional arrangement) is proposed. In this method, the heaters 304 and the liquid discharge ports 303 are arranged non-linearly, for example, in a staggered arrangement in a plane of the discharge port open surface 305.

However, if an electric connecting portion is disposed on a front surface of the head substrate 301 (on a side provided with the liquid discharge ports) of the head substrate 301, a protruding portion is necessarily formed. As a constitution which does not have any protruding portion, it is considered that a back surface of the head substrate 301 (the surface on a side opposite to the surface provided with the liquid discharge ports) is electrically bonded. Therefore, Japanese Patent Application Laid-Open No. S61-016862 discusses that a penetrating wiring is disposed so as to penetrate the head substrate 301 from the front surface to the back surface of the substrate and that the back surface of the head substrate 301 is connected to an external wiring.

However, a driving element which allows the heaters 304 to generate heat is disposed adjacent to the heaters 304. In consequence, the wirings for driving can be reduced, but it is difficult to draw around wirings of a logic circuit which drives the driving element. Therefore, a wiring region needs to be secured. For this purpose, when the liquid discharge ports 303 (or the heaters 304) are two-dimensionally arranged, a size of the head substrate sometimes increases.

Moreover, when a liquid path extends from the liquid supply port to the liquid discharge port through a liquid chamber where the heater is disposed, the path is halfway separated so as to supply the liquid from one liquid supply port to two liquid discharge ports. In this structure, a length difference is made between the liquid paths extending to two liquid discharge ports owing to a manufacturing error. A fluctuation might be generated in discharge performances from the individual liquid discharge ports, depending on this difference.

SUMMARY OF THE INVENTION

An object of the present invention is to provide a liquid discharge head in which liquid discharge ports and heating resistors are arranged closer to one another, and liquids can be discharged from the liquid discharge ports without any fluctuation.

Another object of the present invention is to provide a liquid discharge head including: a substrate; a plurality of discharge units each including one liquid discharge port which discharges a liquid, an energy generating element which is formed on the surface of the substrate and which generates energy to discharge the liquid from the liquid discharge port, one liquid chamber in which the energy generating element is disposed, one liquid supply port formed so as to penetrate the substrate, one liquid path which extends from the liquid supply port to the liquid discharge port through the liquid chamber, a penetrating wiring formed so as to penetrate the substrate, an element wiring which connects the energy generating element to the penetrating wiring and a driving element which is disposed on a back surface of the substrate and which drives the energy generating element through the penetrating wiring; and a common liquid chamber disposed so as to communicate with the substrate along the surface of which the discharge units are arranged through liquid routes having an equal distance to all of the liquid supply ports.

Further features of the present invention will become apparent from the following description of exemplary embodiments with reference to the attached drawings.

DESCRIPTION OF THE EMBODIMENTS

An embodiment of the present invention will hereinafter be described with reference to the drawings.

Figure 1A:
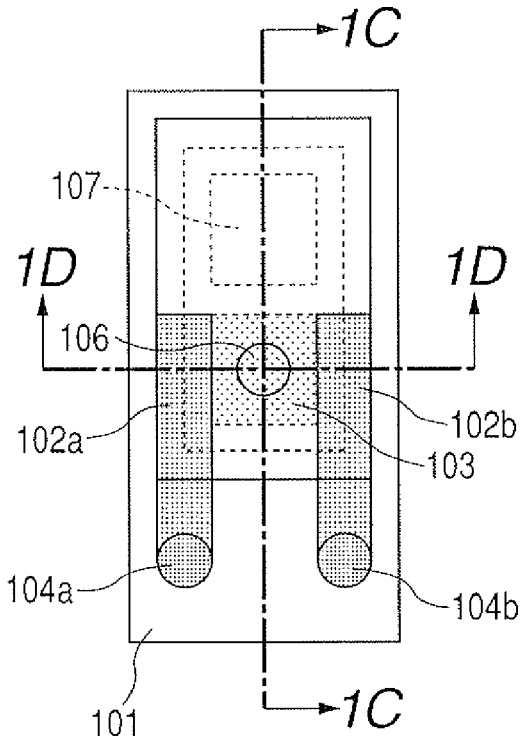
FIGS. 1A, 1B, 1C and 1D illustrate diagrams of a completed state of a liquid discharge head according to an embodiment of the present invention.
Figure 1B:
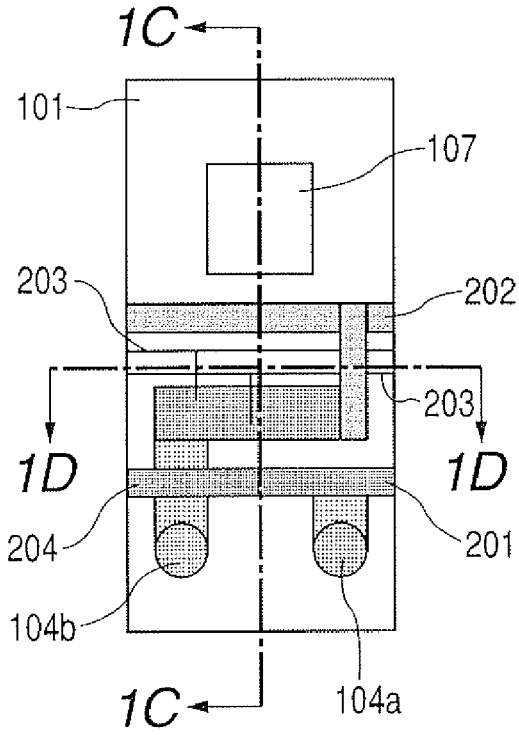
Figure 1C:
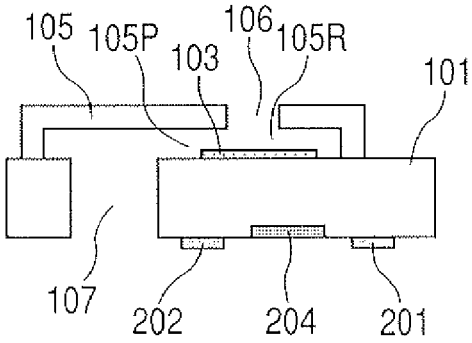
Figure 1D:
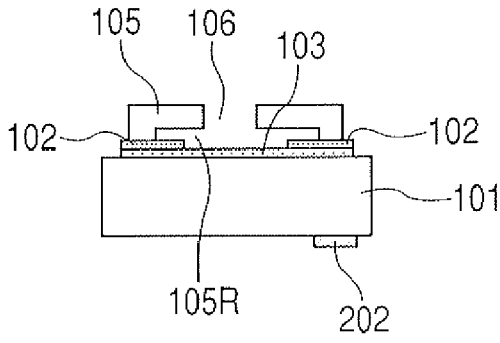

FIGS. 1A, 1B, 1C and 1D illustrate a completed state of a liquid discharge head according to an embodiment of the present invention. FIG. 1A is a plan view of the liquid discharge head of the present embodiment as viewed from the surface of a head substrate, FIG. 1B is a plan view viewed from the back surface of the head substrate on a side opposite to a side of FIG. 1A, FIG. 1C is a sectional view cut along the 1C-1C line of FIGS. 1A and 1B, and FIG. 1D is a sectional view cut along the 1D-1D line of FIGS. 1A and 1B.

Moreover, FIGS. 2A to 5D are explanatory views of manufacturing steps of the liquid discharge head according to the present embodiment.

Here, FIGS. 2A, 3A, 4A and 5A are plan views illustrating a front surface of the head substrate, and FIGS. 2B, 3B, 4B and 5B are plan views illustrating the back surface of the head substrate.

Figure 2A:
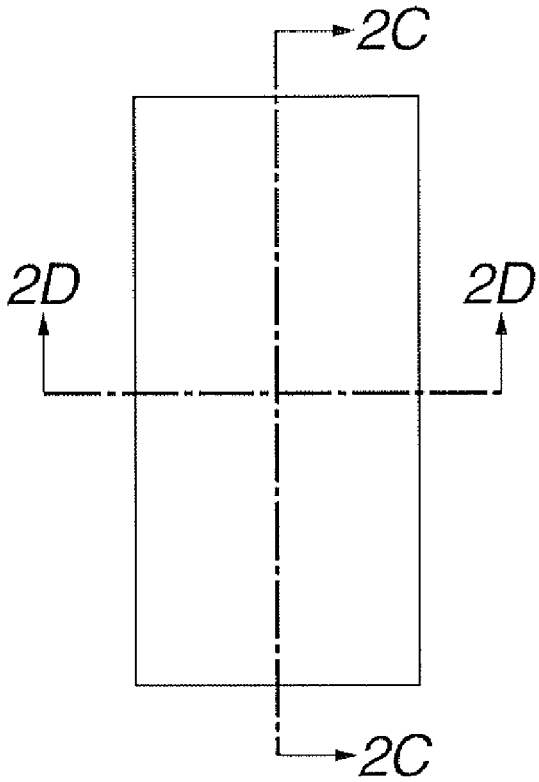
FIGS. 2A, 2B, 2C and 2D illustrate explanatory views of manufacturing steps of the liquid discharge head according to the embodiment of the present invention.
Figure 2B:
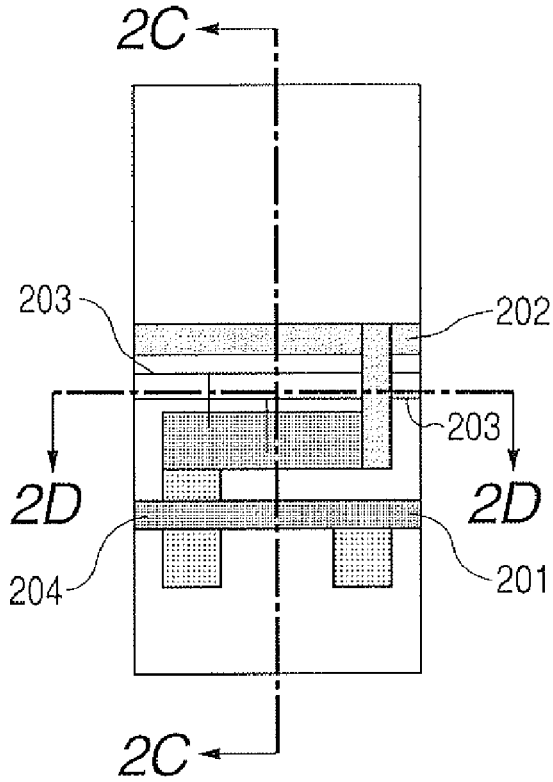
Figure 2C:
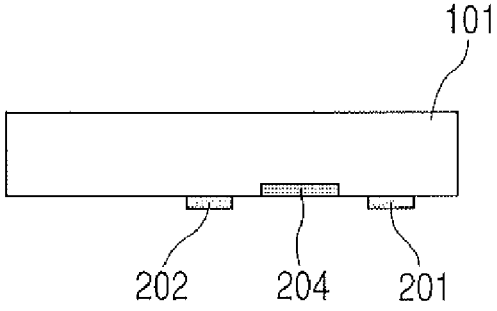
Figure 2D:
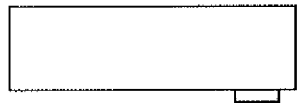

Furthermore, FIG. 2C is a sectional view cut along the 2C-2C line of FIGS. 2A and 2B, and FIG. 2D is a sectional view cut along the 2D-2D line of FIGS. 2A and 2B.

Figure 3A:
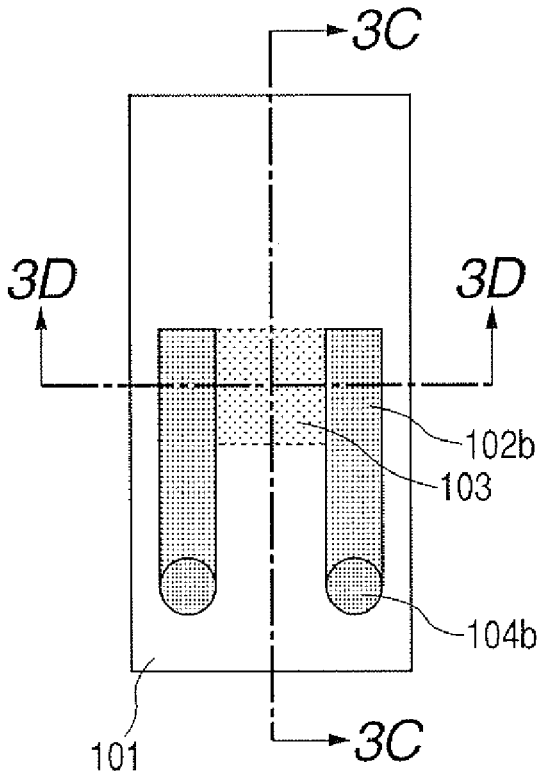
FIGS. 3A, 3B, 3C and 3D illustrate explanatory views of manufacturing steps of the liquid discharge head according to the embodiment of the present invention.
Figure 3B:
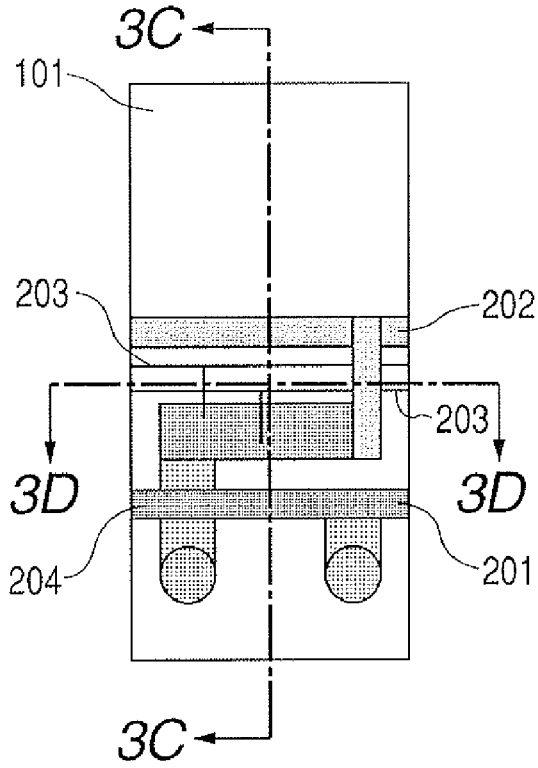
Figure 3C:
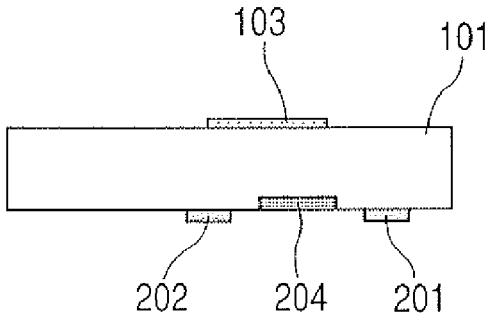
Figure 3D:
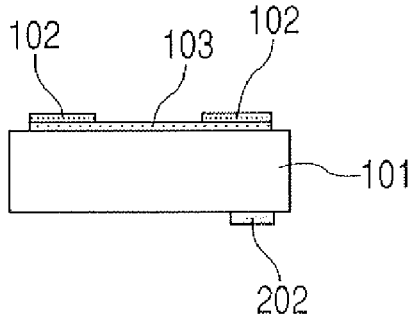

In addition, FIG. 3C is a sectional view cut along the 3C-3C line of FIGS. 3A and 3B, and FIG. 3D is a sectional view cut along the 3D-3D line of FIGS. 3A and 3B.

Figure 4A:
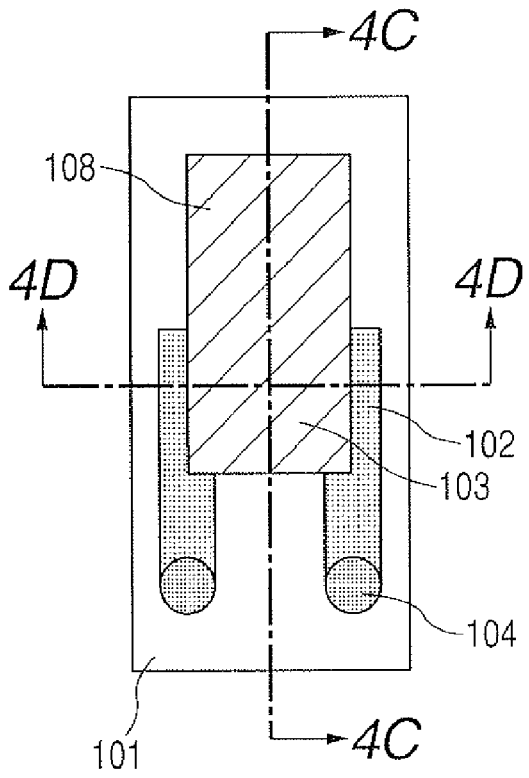
FIGS. 4A, 4B, 4C and 4D illustrate explanatory views of manufacturing steps of the liquid discharge head according to the embodiment of the present invention.
Figure 4B:
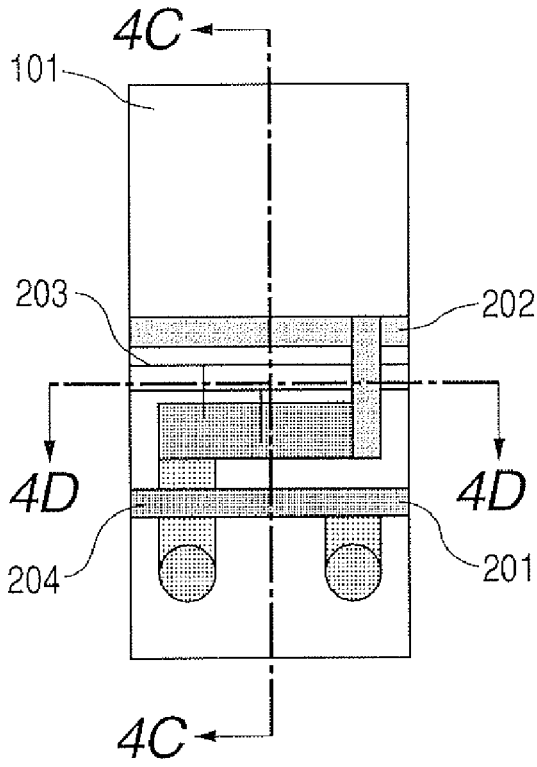
Figure 4C:
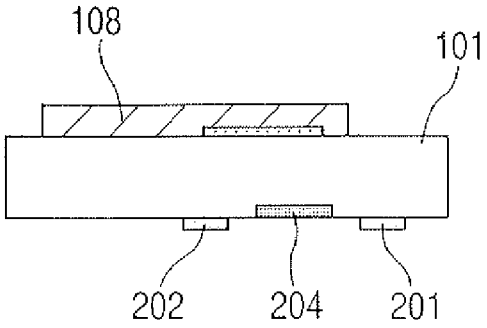
Figure 4D:
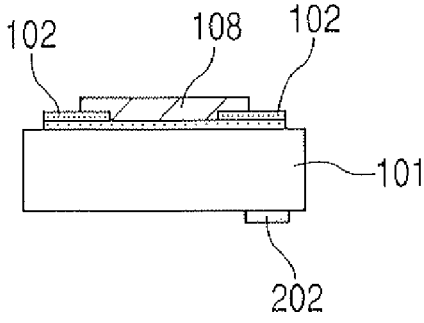

Moreover, FIG. 4C is a sectional view cut along the 4C-4C line of FIGS. 4A and 4B, and FIG. 4D is a sectional view cut along the 4D-4D line of FIGS. 4A and 4B.

Figure 5A:
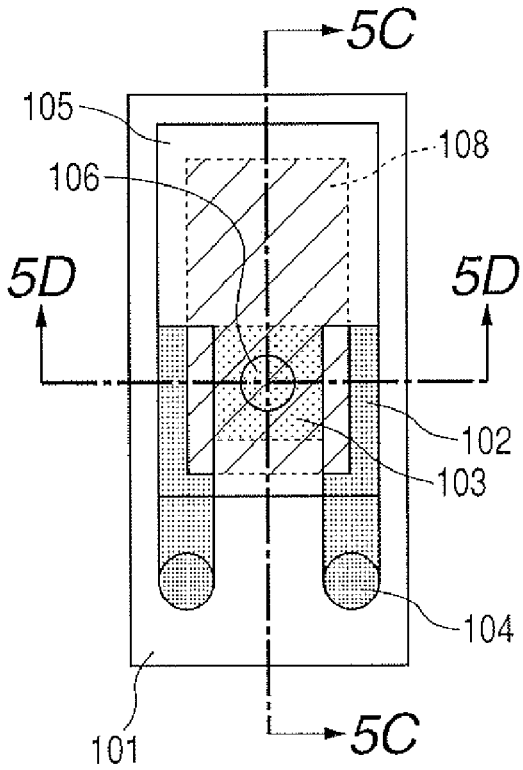
FIGS. 5A, 5B, 5C and 5D illustrate explanatory views of manufacturing steps of the liquid discharge head according to the embodiment of the present invention.
Figure 5B:
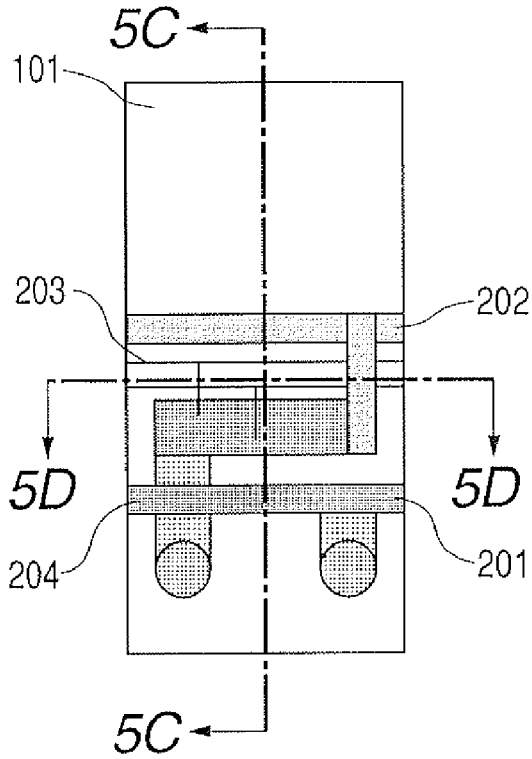
Figure 5C:
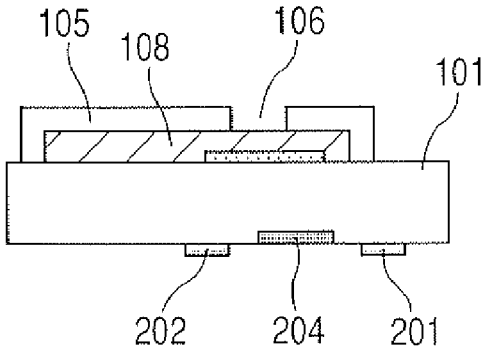
Figure 5D:
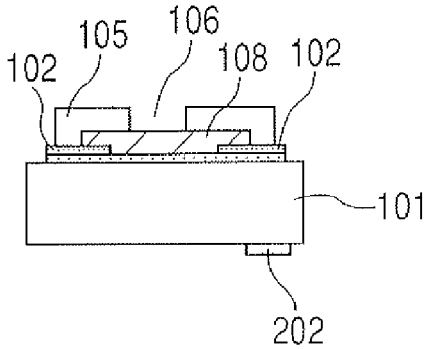

Furthermore, FIG. 5C is a sectional view cut along the 5C-5C line of FIGS. 5A and 5B, and FIG. 5D is a sectional view cut along the 5D-5D line of FIGS. 5A and 5B.

Referring to FIGS. 1A, 1B, 1C and 1D, in a liquid discharge head 100 of the present embodiment, a flow path forming member 105 and the like are formed on a substrate obtained by cutting a silicon substrate 101 into a predetermined shape. A heating resistor (a heater) 103 is formed as a discharge energy generating element on the surface of the silicon substrate 101 on which the flow path forming member 105 is formed (a front surface of the liquid discharge head 100). Furthermore, element wirings 102 are also formed on the same surface of the substrate. The element wirings are connected to opposite ends of the heater 103, and apply power supplied from the outside to the heater 103.

The flow path forming member 105 includes a liquid chamber 105R in which the heater 103 is disposed and which is formed so as to cover this heater 103. The flow path forming member also includes a liquid path 105P which connects this liquid chamber to a liquid supply port 107. Here, the liquid chamber 105R forms a part of the liquid path 105P. Furthermore, a liquid discharge port 106 opens at a portion of the flow path forming member 105 which faces the heater 103. An opening of the discharge port 106 communicates with the liquid chamber 105R, and is positioned at an end of the liquid path 105P. The liquid supply port 107 penetrates the silicon substrate 101 from the front surface (the surface on a side provided with the flow path forming member 105) to the back surface on the opposite side.

On the back surface of the silicon substrate 101, a driving element 204 which allows the heater 103 to generate heat, two electric power wirings 201 and 202 and a logic wiring 203 are arranged. The driving element 204 is formed integrally in the silicon substrate 101. The two electric power wirings 201 and 202 extend on opposite sides of the driving element 204. The logic wiring 203 is electrically connected to the driving element 204. Moreover, a penetrating wiring 104 is disposed so as to penetrate the silicon substrate 101 from the front surface to the back surface.

More specifically, one electric power wiring 201 of the two electric power wirings extends from the back surface of the silicon substrate 101, and is electrically connected to one end of the heater 103 through a penetrating wiring 104*a* and an element wiring 102*a* on the front surface of the silicon substrate 101. The other electric power wiring 202 is electrically connected to the other end of the heater 103 through the driving element 204 disposed on the back surface of the silicon substrate 101, a penetrating wiring 104*b* and an element wiring 102*b* disposed on the front surface of the silicon substrate 101.

As described above, as shown in FIGS. 1A, 1B, 1C and 1D, first, one liquid supply port 107, one liquid chamber 105R and one liquid discharge port 106 form a basic constitution. The driving element 204, the penetrating wirings 104*a* and 104*b*, the heater 103 and the element wirings 102*a* and 102*b* are added to this constitution, and the whole constitution is disposed on each of the front surface and the back surface of the head substrate which are opposed to each other. In consequence, one discharge unit of the present embodiment is formed.

It is to be noted that in FIGS. 1A, 1B, 1C and 1D, one heater 103 is disposed in one liquid chamber 105R, but one discharge unit of the present embodiment also includes a constitution in which heaters connected to one another in series are arranged in one liquid chamber 105R.

Moreover, FIGS. 1A, 1B, 1C and 1D illustrate the only discharge unit corresponding to one liquid discharge port 106, but an actual liquid discharge head includes a large number of arranged liquid discharge ports 106 in most cases. In this case, the above discharge units are two-dimensionally arranged in a plane of the silicon substrate (which is not a linear arrangement), and a highly dense arrangement of the liquid discharge ports 106 can be realized. In a configuration including the plurality of liquid discharge ports 106 in this manner, the electric power wirings 201 and 202 arranged in one discharge unit form a part of an electrode wiring of the whole liquid discharge head. The logic wiring 203 disposed in one discharge unit forms a part of the logic wiring of the whole liquid discharge head.

Next, a manufacturing method of the head according to the present embodiment will be described with reference to FIGS. 1A to 5D.

First, opposite surfaces of the silicon substrate 101 are polished to form the substrate having a thickness of 300 μm. On one of the surfaces of the substrate, as shown in FIGS. 2A, 2B, 2C and 2D, the electric power wirings 201 and 202, the logic wiring 203 and the driving element 204 are formed by a semiconductor technology.

Subsequently, as shown in FIGS. 3A, 3B, 3C and 3D, on the surface of the silicon substrate 101 opposite to the surface of the substrate on which the driving element 204 and the like have been formed, a film is formed of TaN which is a material of the heater 103 by a sputtering process, and the heater 103 is formed by a photolithography technology. Furthermore, on the same surface, a film is formed of Al which is a material of the element wiring 102 by the sputtering process, and the element wiring 102 is formed by the photolithography technology. The heater has a size of 20 μm×20 μm. Here, a protective layer may be disposed on the heater 103 and the element wiring 102 in order to protect the heater and the element wiring.

Next, a portion which forms the penetrating wiring 104 on the silicon substrate 101 is subjected to etching by a dry etching process so as to form a penetrating hole having a diameter of 20 μm. Moreover, a film of a plating seed layer is formed over the penetrating hole, and the penetrating wiring 104 is formed by plating the film with gold so as to fill in the hole by an electrolytic plating process. Next, the penetrating wiring 104, the driving element 204, the electric power wirings 201 and 202 and the logic wiring 203 are appropriately wired. Subsequently, a protective layer is disposed so as to protect these wirings from the liquid. In consequence, a liquid discharge head substrate (hereinafter referred to also as an element substrate) is completed in which the heater 103 disposed on the front surface of the substrate is driven using the electric power wirings 201 and 202, the driving element 204 and the logic wiring 203 arranged on the back surface of the substrate.

Next, as shown in FIGS. 4A, 4B, 4C and 4D, the surface of the silicon substrate 101 on which the element wiring 102 and the heater 103 have been formed is coated with a thick film of a positive resist 108 having a thickness of 10 μm as a mold for forming the liquid path 105P. A desired pattern is formed by exposure and development.

Moreover, as shown in FIGS. 5A, 5B, 5C and 5D, the developed positive resist 108 is coated with photosensitive negative epoxy having a thickness of 20 μm as the flow path forming member 105, and the liquid discharge port 106 having a diameter of 10 μm is formed by exposure and development.

Subsequently, after forming a mask material for the etching on the back surface of the silicon substrate 101 to form a predetermined patterned shape, the dry etching is performed. In consequence, the liquid supply port 107 is formed as shown in FIGS. 1A, 1B, 1C and 1D. Moreover, the positive resist 108 which is the mold material of the liquid path 105P is removed, and the liquid discharge head substrate is completed.

One liquid discharge port 106, one liquid chamber 105R, one liquid supply port 107 and one driving element 204 prepared as described above are formed in a quadrangular shape having breadth 60 μm×length 120 μm, and one discharge unit can be designed. This is described with reference to a plan view of FIG. 1A. The one discharge unit can be designed so as to have a lateral dimension (a dimension in a horizontal direction of the drawing) of 60 μm and a longitudinal direction (a dimension in a vertical direction of the drawing) of 120 μm.

For example, the heaters are arranged at a pitch of 20 μm which is not more than a heater size. In this case, the heaters cannot linearly be arranged. Therefore, the heaters need to be arranged in a staggered arrangement so that the heaters disposed adjacent to each other are not superimposed on each other. However, when the liquid supply port is formed into a rectangular shape in a heater row direction as in a conventional technology, a length of the liquid path from each heater to the liquid supply port differs with the heater. Therefore, when the heaters are arranged in the staggered arrangement along the rectangular liquid supply port, a difference in a distance of the liquid path from the liquid discharge port to the liquid supply port is made between the adjacent heaters. This difference causes a problem that fluctuations are generated in a discharge performance.

On the other hand, in the liquid discharge head of the present embodiment, any of the liquid paths extending from the liquid discharge port 106 to the liquid supply port 107 can be disposed with a constant distance. Therefore, the problem of the fluctuations in the discharge performance due to the difference in the liquid path length does not occur.

The liquid discharge head of the present embodiment will hereinafter specifically be described with reference to FIGS. 6A, 6B and 6C.

As described above, the one discharge unit of the present embodiment has a size of 60 μm×120 μm. Therefore, when the discharge units are laterally arranged in one row, the heaters 103 and the liquid discharge ports 106 are arranged at a pitch of 60 μm which is a distance D. For example, a distance between the heaters (or between the liquid discharge ports) of a discharge unit 11 and a discharge unit 12 is a pitch of 60 μm.

Figure 6A:
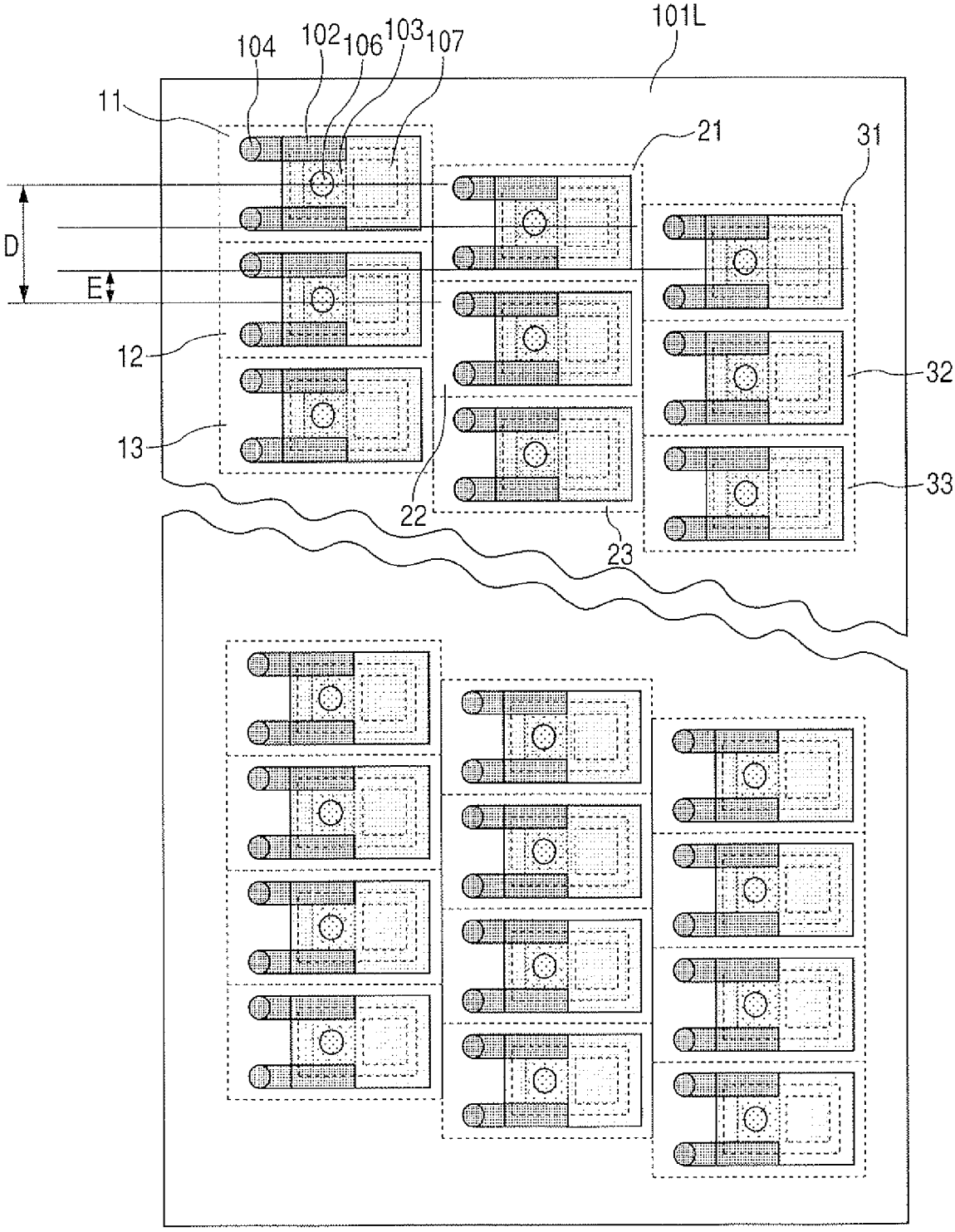
FIGS. 6A, 6B and 6C illustrate explanatory views of the liquid discharge head according to the present invention.

As shown in FIG. 6A, when the discharge units are arranged in three rows in the staggered arrangement, the units can substantially be arranged at a pitch of 20 μm corresponding to a distance E between the heaters (or between the liquid discharge ports). For example, a distance between the heaters (or between the liquid discharge ports) of the discharge unit 12 and a discharge unit 31 is a pitch of 20 μm. Moreover, the driving element 204 is formed on the back surface of the substrate. Therefore, it is not necessary to consider a space for disposing the driving element 204 on the front surface of the substrate. Therefore, even if the units are arranged in three rows, a total width of the units can be within 360 μm.

The electric power wirings 201 and 202 and the logic wiring 203 of each of these discharge units are wired so that driving of the discharge units can be controlled. Furthermore, if necessary, a protective layer is disposed so as to protect the wirings from the liquid. In consequence, discharge units are two-dimensionally arranged on the surface of the silicon substrate to complete one silicon substrate 101L.

Figure 6B:
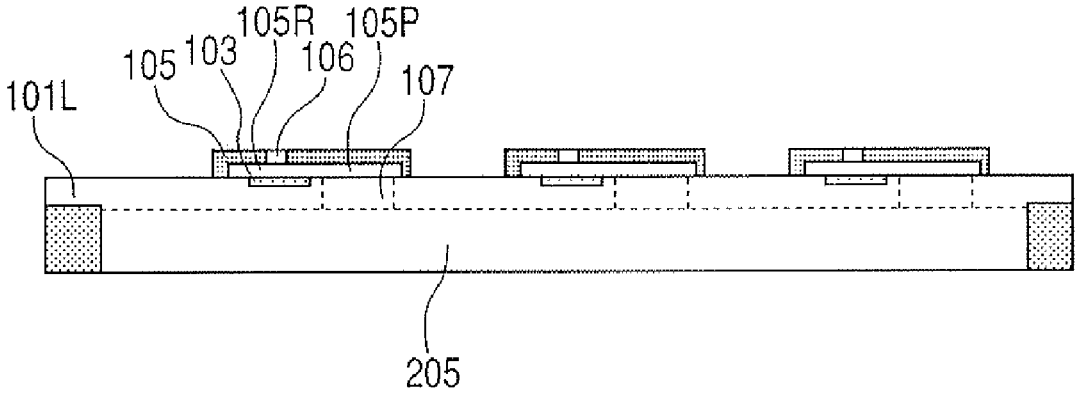
Figure 6C:
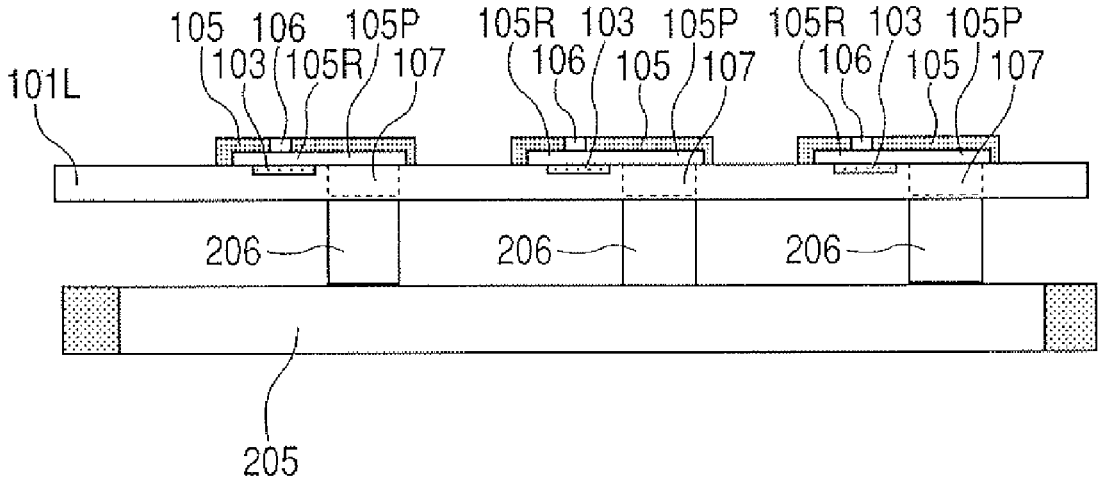
Figure 7A:
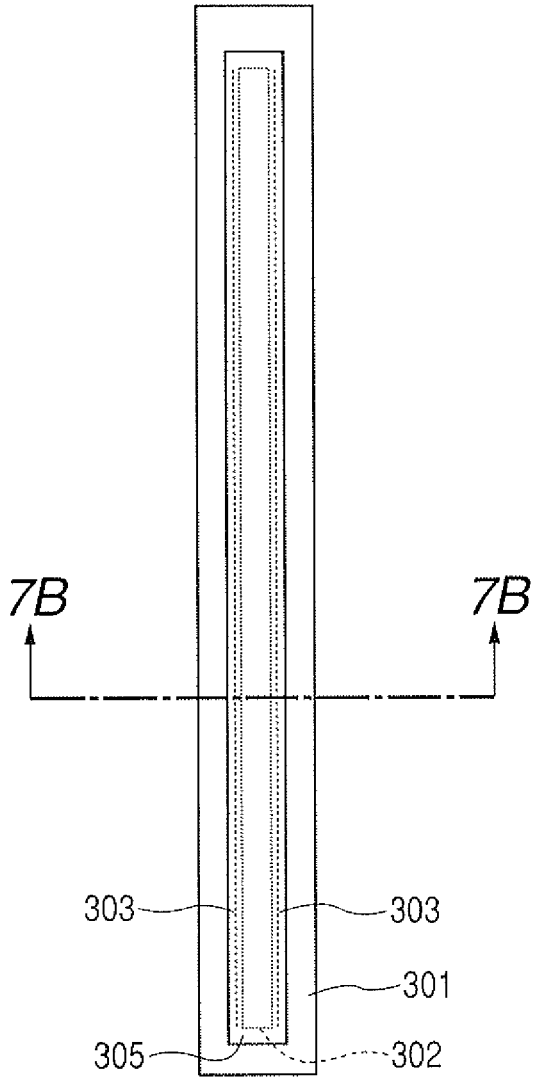
FIGS. 7A and 7B are explanatory views of a conventional liquid discharge head.
Figure 7B:
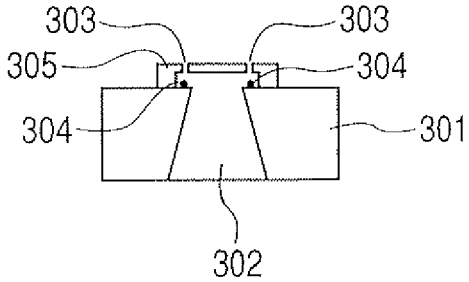

Next, as shown in FIG. 6B, the silicon substrate 101L formed by arranging the plurality of discharge units having the same structure as described above is bonded as a lid to a common liquid chamber 205 so as to close the chamber. The common liquid chamber has an opened upper portion, and stores the liquid therein. In consequence, the liquid discharge head 100 is completed. At this time, the liquid supply ports 107 of all the discharge units communicate with the common liquid chamber 205. It is to be noted that liquid routes 206 which connect the liquid supply ports 107 to the common liquid chamber 205 have an equal length (FIG. 6C). In this case, all the liquid supply ports 107 do not have to be directly bonded to the common liquid chamber. Similarly, a plurality of common liquid chambers 205 may be arranged.

According to such a constitution, all the discharge units may have the equal distance from the common liquid chamber 205 to each liquid supply port 107 and an equal distance of the liquid path 105P which extends from the liquid supply port 107 to the liquid discharge port 106 through the liquid chamber 105R. In consequence, the liquid discharge port 106 can be disposed closer, and fluctuations in liquid discharge from the discharge units can be eliminated.

As described above, there is not any discharge fluctuation among the discharge units. Therefore, conversely, when the discharge unit having a changed distance from the heater to the liquid discharge port is disposed at an appropriate position, the head can be designed so as to correct a time difference between liquid discharge times and positively shift a shot time of the liquid to a medium.

As described above, according to the liquid discharge head of the present embodiment, layout can easily be designed with a degree of freedom in consideration of the discharge timing of each liquid discharge port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-117897, filed Apr. 21, 2006, which is hereby incorporated by reference herein in its entirety.

What is claimed is:

1. A liquid discharge head comprising:

a substrate having a plurality of discharge ports;

a plurality of energy generating elements disposed on a first surface of the substrate for generating energy to discharge liquid from the discharge ports;

a liquid supply port formed to penetrate the substrate from the first surface to a second surface opposite to the first surface;

a member provided on the first surface, forming walls of liquid chambers provided correspondingly to each of the energy generating elements and walls of liquid paths from the liquid supply port through the liquid chambers to the discharge ports;

a plurality of first penetrating electrodes penetrating the substrate from the first surface to the second surface, wherein one of the first penetrating electrodes electrically connects to one of the energy generating elements;

a plurality of second penetrating electrodes penetrating the substrate from the first surface to the second surface, wherein one of the second penetrating electrodes electrically connects to one of the energy generating elements connected to one of the first penetrating electrodes;

a first power wiring provided on the second surface and electrically connected to the plurality of first penetrating electrodes;

a second power wiring provided on the second surface and electrically connected to the plurality of first penetrating electrodes and the plurality of second penetrating electrodes; and a plurality of driving elements electrically connected between the first penetrating electrodes and the first power wiring, corresponding to each of the energy generating elements, to drive and control the energy generating elements.

2. The liquid discharge head according to claim 1, wherein the first power wiring and the second power wiring extend along an extending direction of a row of the energy generating elements, and wherein the driving elements are provided in an area between the first power wiring and the second power wiring.

3. The liquid discharge head according to claim 1, said liquid discharge head further comprising a logic wiring provided between the first power wiring and the second power wiring on the second surface to supply a driving signal to the driving elements.

* * * * *